US007001234B2

(12) United States Patent
Montbarbon

(10) Patent No.: US 7,001,234 B2
(45) Date of Patent: Feb. 21, 2006

(54) MARINE RISER SYSTEM

(75) Inventor: Stephane Montbarbon, Houston, TX (US)

(73) Assignee: Stolt Offshore Inc., Houston, TX (US)

( * ) Notice: Subject to any disclaimer, the term of this patent is extended or adjusted under 35 U.S.C. 154(b) by 13 days.

(21) Appl. No.: 10/416,908

(22) PCT Filed: Nov. 22, 2001

(86) PCT No.: PCT/GB01/05144

§ 371 (c)(1),
(2), (4) Date: Nov. 7, 2003

(87) PCT Pub. No.: WO02/42599

PCT Pub. Date: May 30, 2002

(65) Prior Publication Data

US 2005/0042952 A1 Feb. 24, 2005

Related U.S. Application Data

(60) Provisional application No. 60/252,755, filed on Nov. 22, 2000.

(51) Int. Cl.
*B63B 22/02* (2006.01)

(52) U.S. Cl. ..... 441/3; 405/224.2

(58) Field of Classification Search ..... 441/3–5; 141/1; 405/169, 224.2
See application file for complete search history.

(56) References Cited

U.S. PATENT DOCUMENTS

| | | | | |
|---|---|---|---|---|
| 3,677,310 | A * | 7/1972 | Dobler et al. | 141/1 |
| 4,367,055 | A * | 1/1983 | Gentry et al. | 405/169 |
| 4,490,073 | A * | 12/1984 | Lawson | 405/169 |
| 4,643,614 | A * | 2/1987 | Laursen | 405/169 |
| 4,735,267 | A | 4/1988 | Stevens | 166/345 |
| 4,740,109 | A * | 4/1988 | Horton | 405/224.2 |
| 5,639,187 | A | 6/1997 | Mungall et al. | 405/195.1 |
| 6,062,769 | A | 5/2000 | Cunningham | 405/195.1 |
| 6,082,391 | A | 7/2000 | Thiebaud et al. | 137/236.1 |

FOREIGN PATENT DOCUMENTS

| | | |
|---|---|---|
| EP | 0 459 649 | 12/1991 |
| WO | WO 99 41142 | 8/1999 |
| WO | WO 00 08262 | 2/2000 |
| WO | WO 00 63598 | 10/2000 |

* cited by examiner

*Primary Examiner*—Stephen Avila
(74) *Attorney, Agent, or Firm*—Sheridan Ross P.C.

(57) ABSTRACT

This invention relates to a marine riser system for transferring fluid between a plurality of mutually separated locations on the seabed and a vessel (1) on the surface of the sea. The riser system comprises a submerged buoy (2), a plurality of risers suspended from the buoy (2) to the location on the sea bed and a plurality of flexible conduits (8) extending from the vessel to the submerged buoy (2). Connectors (7) carried by the submerged buoy (2) connect the flexible conduits (8) to the risers (6), each connector being remotely operable to disconnect all the flexible conduits from the risera. A central tether (5) may be provided during an installation phase only, until the risers (6) are in place and hold the buoy (2) by their own tension. Alternatively, the tether (5) may remain in place, and tensioned to limit vertical motion of the buoy.

27 Claims, 2 Drawing Sheets

MARINE RISER SYSTEM

This application claims the benefit of Provision Application No. 60/252,755, filed Nov. 22, 2000.

The present invention relates to a marine riser system for the recovery of hydrocarbons from the seabed to a surface vessel such as a floating production and storage vessel (FPSO) to support risers for example flexible risers, steel catenary risers, or bundles thereof.

In deep water, direct connection of steel catenary risers or bundles to floating facilities is feasible but generates constraints:

The riser must be installed after the FPSO is on location, which is usually on the critical path for planning purposes.

Disconnection takes a long time and is not feasible under adverse weather conditions.

The floating facilities impose on the risers motions which are detrimental in terms of fatigue.

Other systems have been proposed to support risers and notably cylindrical buoys with or without ballasting elements, such as for example U.S. Pat. No. 5,639,187 (Mobil). For large field developments a riser tower can serve the same purpose, in particular for stringent thermal requirements. An example of such a tower is in U.S. Pat. No. 6,082,391 (Stolt Comex Seaway & Doris Engineering).

Small to medium reserves fields require a small number of risers for which a riser tower may not be economical. In addition the expense of a riser tower may not be justified when thermal functional requirements are relaxed.

The aim of the present invention is to provide an alternative form of riser system in which the above mentioned problems are overcome or in the very least alleviated.

The present application proposes in general terms a riser system comprising a central buoy for suspension of risers (flexible risers, steel catenary risers or bundles). The risers may be arrayed symmetrically about the buoy, so as to keep its location by their inherent tension. There may for some applications be a possibility of disconnection from floating facilities.

In accordance with a first aspect of the invention there is provided a marine riser system for transferring fluid between a plurality of mutually separated locations on the seabed and a vessel floating on the surface of the sea, the riser system comprising:

a submerged buoy, a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, a like plurality of flexible conduits extending from the vessel to the submerged buoy, a respective connector carried by the submerged buoy and connecting the lower end of the respective flexible conduit to the upper end of one of the risers.

The invention in its preferred embodiments provides riser systems having the following features:

low cost subsurface buoy located away from the seawater surface to minimise the impact of waves;

small vertical and horizontal loads allowing "soft" connection to the floating facilities;

design suitable for spread mooring or turret mounted mooring, in which case it serves as a disconnectable mooring system without the cost associated with large forged and machined parts;

Suitable for rapid disconnection; and

No bending moment is applied to the risers by the movement of the buoy.

With the system of the present invention two or more risers can be accommodated. In addition the buoy may be tethered to a mooring such as a suction anchor. In particular three to eight risers may be arrayed at approximately regular angular positions around the central buoy.

The lines between the subsurface buoy and the floating facilities may be flexible pipes arranged in for example, a "Chinese lantern" pattern. Using connectors of a type known per se, the lines may be disconnected in a matter of hours in case of inclement weather and reinstallation achieved relatively easily.

Further aspects of the marine riser system are detailed in the appended claims of this application.

In accordance with a second aspect of the invention there is provided a method of installing a marine riser system in accordance with the first aspect of the invention, the method comprising the steps of:

tethering the buoy to an anchor at a location which is horizontally intermediate the sea bed locations and which is vertically beneath the sea surface, suspending each of the plurality of risers on the buoy to extend therefrom to a respective one of the sea bed locations, providing a respective connector on the upper end of each riser, subsequently stationing the vessel to have its centre of yaw substantially directly above the buoy, extending an appropriate plurality of flexible conduits from the vessel each to a respective one of the connectors, and connecting the flexible conduits to the respective connector.

Further, optional aspects of the method are detailed in the dependent claims.

BRIEF DESCRIPTION OF THE DRAWINGS

Embodiments of the invention will now be described, by way of example only, with reference to the accompanying drawings, in which.

DETAILED DESCRIPTION OF THE EXEMPLARY EMBODIMENTS

The examples to be described embody two basic schemes for the riser system. In a first scheme (to be described further with reference to FIG. 1), the subsurface buoy is connected to a mooring system only during the installation phase. After installation, the mooring is removed, and the tension in the risers themselves keeps the buoy in position. In the second scheme (FIG. 2), by contrast, after riser installation is completed, the buoy tether is tensioned to eliminate buoy vertical movement. This accommodates variations in the density of fluid contained in the risers, which may include water, oil and gas in different proportions during operation.

Figure 1:
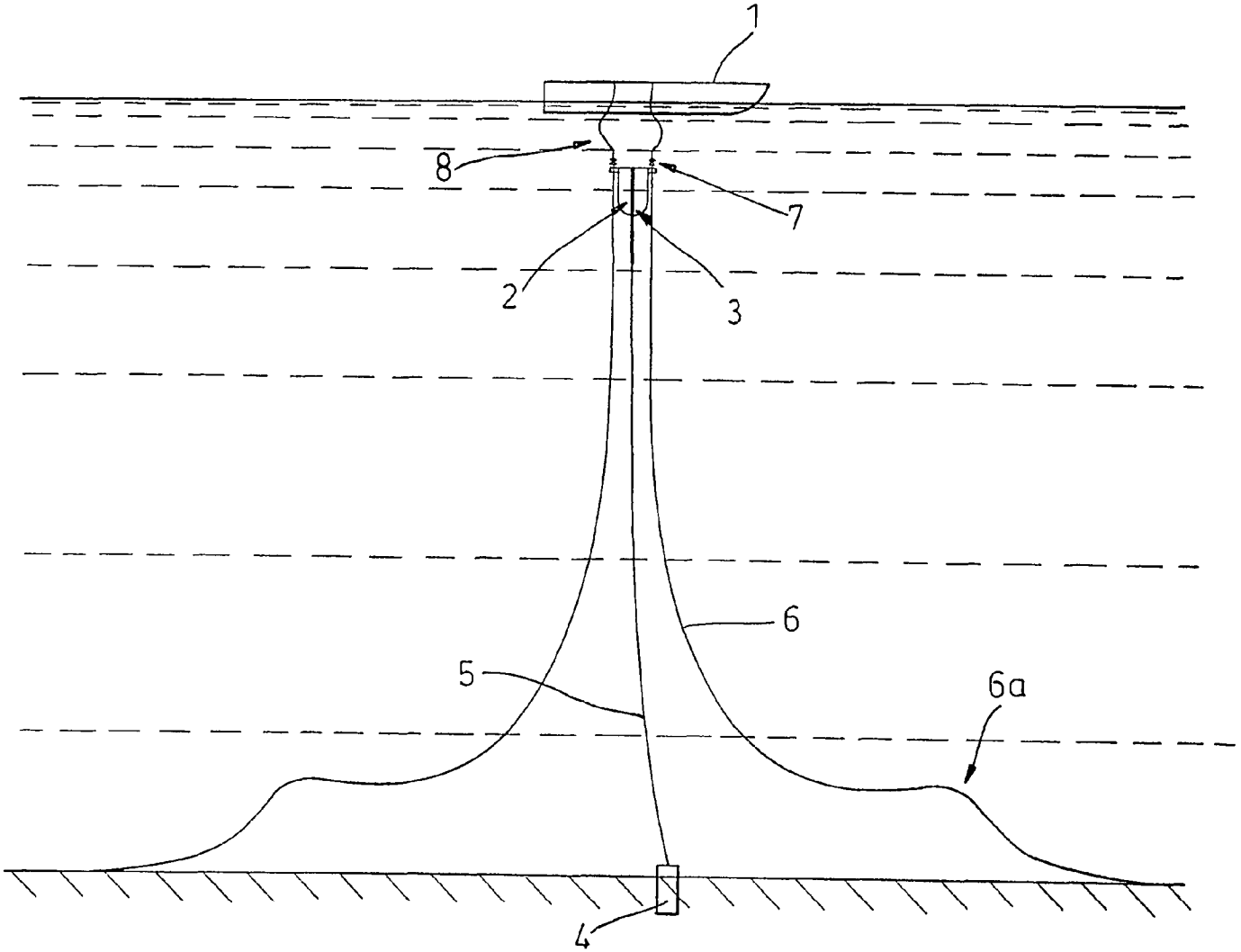
FIG. 1 shows the installation of marine riser system according to the present invention in which a subsurface buoy is connected to a mooring system only during the installation phase.

Referring firstly to FIG. 1, the riser system includes a FPSO 1, a subsurface buoy 2 including a roll motion damper 3, and a suction anchor 4 which is deployed in the sea bed. During installation, subsurface buoy 2 is connected by a tether line 5 to the suction anchor 4, during installation process shown. Further the subsurface buoy 2 is connected by risers or riser bundles 6 to the sea bed. The risers 6 may be steel catenary risers or flexible risers depending on the characteristics of the production system. In the example shown, the simple Catenary configuration is modified to provide a "lazy wave" shape at 6*a*, using buoyancy devices in a known manner. This shape and other buoyed configurations are all included within the general term "Catenary riser", as used herein.

During the installation of the marine riser system the tether line 5 loosely connects the suction anchor 4 and the subsurface buoy 2 to hold the component parts of the system in place while the risers 6 themselves are installed. Once the construction and the location of the component parts of the system is complete the tether line 5 is removed, and the buoy is kept in its place both vertically and horizontally, by the balanced tension in all of the risers The minimum number of risers is two for this purpose. In practice, however, a more or-less circular array of three, four, five, six, eight or so on risers may be accommodated.

During this installation process, although shown in FIG. 1 for completeness, FPSO 1 need not be on station, or even be built at all. Each riser 6 terminates at the buoy 2 in a connector 7. At the appropriate time, FPSO 1 is connected to the risers 6 through flexible jumpers 8. These may bulge as shown, in a form of "Chinese lantern", the extra length accommodating movement of the FPSO 1 without putting strain on the risers themselves.

The system may include a remote control emergency disconnect system which is located to disconnect the risers 6 and flexible conduits 8 at the subsurface buoy 2. Connectors 7 suitable for this purpose are known per se.

It should be noted that other anchor systems can be used instead of the suction anchor system illustrated in this example.

Figure 2:
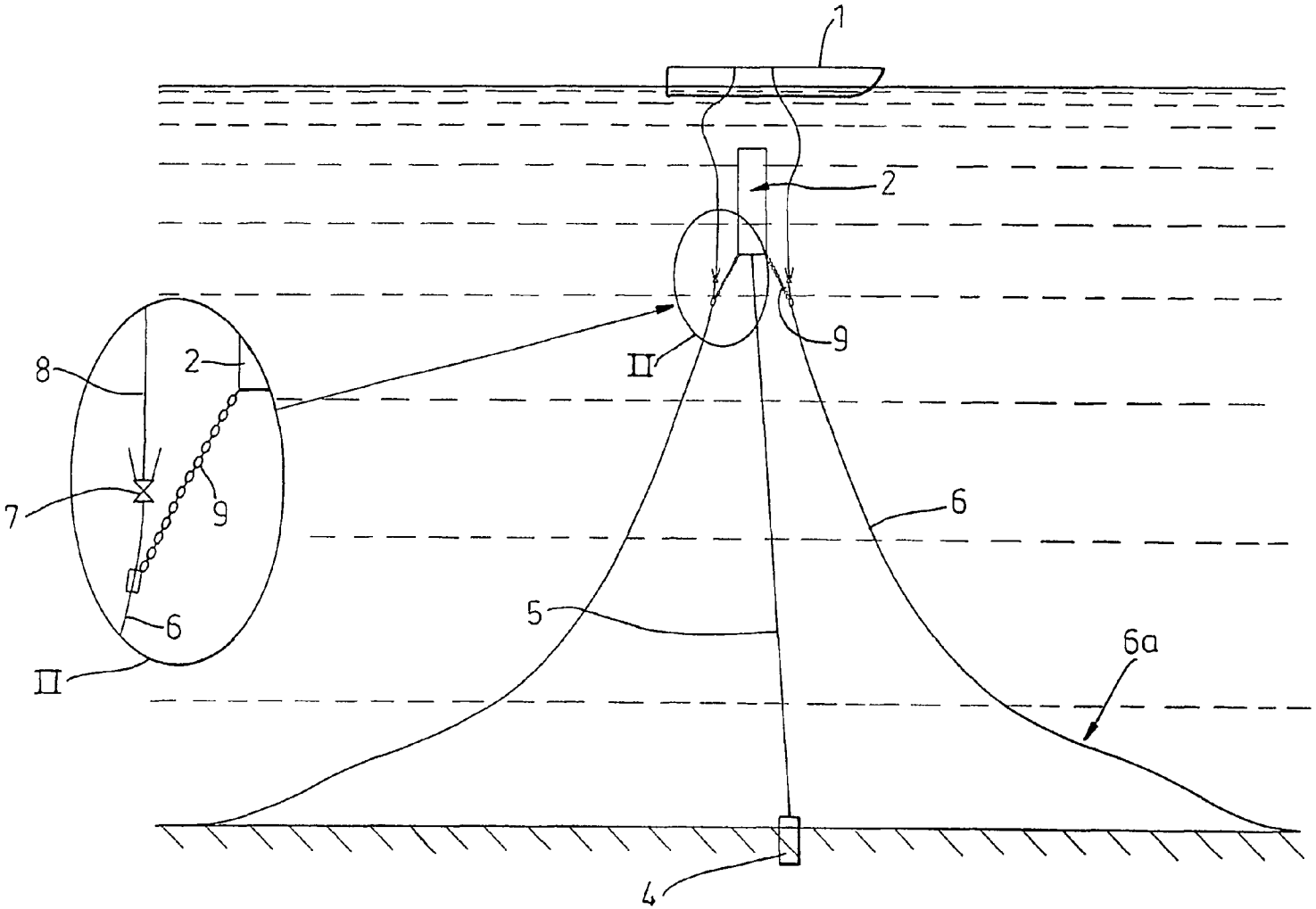
FIG. 2 shows the system after riser installation is completed, and the buoy tether is tensioned to eliminate buoy vertical movement.

FIG. 2 of the drawings shows a similar system but according to the second scheme mentioned above. The same reference signs are used to denote corresponding parts. Rather than remove tether 5 in this example, it is actively tensioned and remains in place as part of the installation. The tension in the tether line 5 helps to eliminate buoy vertical movement. This accommodates for example variations in the density of fluid contained in the risers, which may include water, oil and gas in different proportions during operation.

Referring particularly to the inset detail (oval II) in FIG. 2, this example also shows a variation in the manner of connection of the risers 6 to the flexible conduits 8 at the subsurface buoy 2. In the arrangement shown each riser 6 is connected to the buoy 2 by a flexible link 9, such as a chain. Each remotely operable connection 7 is located above the chain linkage at the upper end of the respective riser 6 and this remotely operable connection is relatively free of other mechanical connection to the buoy 2.

The remotely operable connection 7 forms part of the remotely controlled emergency disconnected system mentioned above.

The systems illustrated provide an alternative to the known riser systems mentioned in the introduction, and are especially suited for deepwater and ultra-deep field developments for small to medium reserves, particularly in areas where disconnection is a requirement because of sudden adverse meteorological and ocean conditions.

Modifications and other examples will readily be envisaged by the person skilled in the art, within the spirit and scope of the invention is not intended to be limited in any way by the examples disclosed.

The invention claimed is:

1. A marine riser system for transferring fluid between a plurality of mutually separated locations on the seabed and a vessel floating on the surface of the sea, the riser system comprising:

(a) submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the risers are each suspended from the buoy by means of a respective flexible link.

2. A marine riser system as claimed in claim 1 wherein each connector is remotely operable to disconnect all the flexible conduits from the risers.

3. A marine riser system as claimed in claim 1, wherein the vessel in use is stationed above the buoy such that the buoy is substantially directly below the center of yaw of the vessel.

4. A marine riser system as claimed in claim 1, wherein the submerged buoy is tethered substantially vertically to an anchor in the sea bed.

5. A marine riser system as claimed in claim 1, wherein the submerged buoy is held submerged by the weight of said risers without a central anchor.

6. A marine riser system as claimed in claim 1, wherein the buoy is submerged to a depth below the depth to which wave disturbances can normally penetrate.

7. A marine riser system as claimed in claim 1, wherein the sea bed locations are disposed substantially symmetrically about a central point that is substantially directly beneath the buoy.

8. A marine riser system as claimed in claim 1, wherein the suspension of the risers from the buoy is disposed to minimize the transfer of bending moment from the buoy to the risers.

9. A marine riser system as claimed in claim 6, wherein the buoy is fitted with roll motion damping means.

10. A marine riser system as claimed in claim 1, wherein each flexible link comprises a respective chain whose length is substantially less than the length of the riser suspended by that length of chain.

11. A marine riser system as claimed in claim 1, wherein at least one riser comprises steel pipe disposed in a catenary.

12. A marine riser system as claimed in claim 1, wherein at least one riser comprises a flexible pipe or hose.

13. A marine riser system as claimed in claim 1, wherein at least one riser comprises a bundle of fluid transporting conduits.

14. A marine riser system as claimed in claim 1, wherein the end of at least one riser adjacent the sea bed is disposed in a wave formation.

15. A marine riser system as claimed in claim 1, wherein the plurality of flexible conduits extending from the vessel each to a respective connector are collectively disposed in an array resembling a "Chinese lantern".

16. A method of installing a marine riser system as claimed in claim 1, the method comprising the steps of:

(a) tethering the buoy to an anchor at a location which is horizontally intermediate the sea bed locations and which is vertically beneath the sea surface, (b) suspending each of the plurality of risers on the buoy to extend therefrom to a respective one of the sea bed locations, (c) providing a respective connector on the upper end of each riser, subsequently stationing the vessel to have its center of yaw substantially directly above the buoy, (d) extending an appropriate plurality of flexible conduits from the vessel each to a respective one of the connectors, and (e) connecting the flexible conduits to the respective connector.

17. A method as claimed in claim 16, characterized by the further step of subsequently removing the tether of the buoy whereby the buoy is thereafter kept stationed by tension in the risers.

18. A method as claimed in claim 16, wherein after the risers are installed, the tether of the buoy is tensioned at least to an extent that substantially eliminates vertical movement of the buoy whereby substantially to avoid positional disturbances of the riser system induced by variations of the densities of fluids carried by the risers in use of the riser system.

19. A method as claimed in claim 16, wherein the plurality of flexible conduits extended from the vessel each to a respective connector are collectively disposed in an array resembling a "Chinese lantern".

20. A method as claimed in claim 16, wherein the buoy is submerged to a depth below the depth to which substantial wave disturbances normally penetrate.

21. A method as claimed in claim 16, characterized that the sea bed locations are disposed substantially symmetrically around a central point that is substantially directly beneath the buoy.

22. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the vessel in use is stationed above the buoy such that the buoy is substantially directly below the center of yaw of the vessel.

23. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the submerged buoy is tethered substantially vertically to an anchor in the sea bed.

24. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the buoy is fitted with roll motion damping means.

25. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein at least one riser comprises steel pipe disposed in a catenary.

26. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the end of at least one riser adjacent the sea bed is disposed in a wave formation.

27. A marine riser system for transferring fluid between a plurality of mutually separated locations on the seabed and a vessel floating on the surface of the sea, the riser system comprising:

(a) a submerged buoy, (b) a like plurality of risers each suspended from the buoy and extending from the buoy in mutually different directions to a respective one of the locations on the sea bed whereby differently acting directions of riser-weight-applied pull on the buoy tend to keep the buoy horizontally between the locations, the vessel floating substantially above the submerged buoy, (c) a like plurality of flexible conduits extending from the vessel to the submerged buoy, (d) a respective connector carried by the submerged buoy and connecting the lower end of the respective flexible conduit to the upper end of one of the risers; and (e) wherein the plurality of flexible conduits extending from the vessel each to a respective connector are collectively disposed in an array resembling a "Chinese lantern").

* * * * *

UNITED STATES PATENT AND TRADEMARK OFFICE

CERTIFICATE OF CORRECTION

PATENT NO. : 7,001,234 B2
APPLICATION NO. : 10/416908
DATED : February 21, 2006
INVENTOR(S) : Montbarbon It is certified that error appears in the above-identified patent and that said Letters Patent is hereby corrected as shown below:

Column 4
Line 12, after "(a)" please insert --a--.

Column 8
Line 12, please delete ")".

Signed and Sealed this

First Day of August, 2006

JON W. DUDAS
*Director of the United States Patent and Trademark Office*